US005713741A

United States Patent [19]

DeMars

[11] Patent Number: 5,713,741

[45] Date of Patent: Feb. 3, 1998

[54] STORYBOOK PILLOW

[76] Inventor: Robert A. DeMars, 5000 N. Pkwy. Calabasas, Suite 233, Calabasas, Calif. 91302

[21] Appl. No.: 654,224

[22] Filed: May 28, 1996

[51] Int. Cl.[6] ..... A47G 9/02

[52] U.S. Cl. ..... 434/319; 5/639; 5/904

[58] Field of Search ..... 434/308, 309, 434/317, 319, 365; 5/639, 904

[56] References Cited

U.S. PATENT DOCUMENTS 2,958,769 11/1960 Bounds ..... 5/639
3,946,316 3/1976 Hough ..... 325/310
4,782,533 11/1988 Haynie ..... 381/24
5,179,747 1/1993 Zink ..... 5/639
5,538,430 7/1996 Smith et al. ..... 434/178

*Primary Examiner*—Richard J. Apley
*Assistant Examiner*—Glenn E. Richman
*Attorney, Agent, or Firm*—Jack C. Munko

[57] ABSTRACT

A storybook pillow where a pillow that is designed to rest the head of a human includes a radio transmitter. Upon the pillow being used by applying pressure to the pillow by the users head, the radio transmitter is activated emitting a signal. A radio receiver, separate from the pillow but located in close proximity thereto picks up the signal and activates a sound playback device which reproduces a recorded sound. The radio receiver is to be mounted in conjunction with the representation of a book.

7 Claims, 4 Drawing Sheets

STORYBOOK PILLOW

BACKGROUND OF THE INVENTION

1. Field of the Invention

The field of this invention relates to sound recording devices and more particularly to a sound playback device which is activated by an individual resting his or her head on a pillow.

2. Description of the Prior Art

The present invention relates, in general, to an apparatus producing sounds for inducing sleep in a human. With respect to children, it has long been a common practice to induce sleep by telling of a story while the child is laying within his or her bed. It is not always convenient to have a human, such as a parent, read a story to the child. In such an event, it has been common to utilize a sound recording such as a cassette tape player that "tells the story" to the child. However, the cassette tape player must be manually activated and then deactivated at the time the child is asleep. A conventional tape recorder thereby requires monitoring by a separate human to affect activation and deactivation of the recorder.

In the past, it has been known to combine a radio with a pillow. The purpose of the radio was to emit sounds which would result in inducing of sleep of the human user. However, the pillows of the past that include radios were generally bulky and included a hard structure where the radio was located in a portion of the pillow. Upon the users head coming in contact with that portion of the pillow, the user would almost certainly be awakened. Additionally, these pillows had control knobs sticking out of the pillow and were thus substantially uncomfortable in use especially when a user accidentally placed his or her head on these control knobs. Also, these radios had to be manually operated (turned on, turned off, tuned and volume control).

SUMMARY OF THE INVENTION

The apparatus of the present invention is designed to be used in conjunction with a conventional pillow which is used by a human when resting or sleeping. The human generally applies pressure to the pillow by placing his or her head on the pillow. Incorporated within the pillow is a small transmitter compartment. The transmitter compartment connects to a main compartment. The main compartment includes an inflatable bladder a portion of which is mounted within the transmitter compartment. The transmitter circuit of the transmitter is to be activated by the enlarging of the inflatable bladder portion located within the transmitter compartment. Such inflation results from head pressure on the pillow which contains the bladder. The enlarging causes contact between the electrical contacts. The transmitter circuit, when activated, produces a signal which is to be picked up by a receiver located spaced from the pillow but in close proximity thereto. The circuit of the receiver will cause a sound playback device, such as a tape recorder, to play certain sounds such as tell a story from a book. It is intended that the receiver be mounted in conjunction with the book with the book actually being capable of being read. The user, if desired, can read the book simultaneously with the playing of the story.

The primary objective of the present invention is to provide a sound playback apparatus which is activated upon a human placing his or her head on a pillow to induce the human to go to sleep.

Another objective of the present invention is to construct a sound playback apparatus which can be used by children as a substitute for a parent reading a story to the child.

Another objective of the present invention is to construct a sound playback apparatus which can be manufactured at a reasonably inexpensive price and thereby sold to the consumer at a reasonably inexpensive price.

Another objective of the present invention is for safety reasons there are no cords interconnecting the transmitter and the receiver thereby eliminating the possibility of a child becoming entangled or shocked by an electrical cord.

Another objective of the present invention is that the shape and size of the transmitter is selected to be of little effect if the user places his or her head directly on the area of the pillow that contains the transmitter.

Another objective of the present invention is that the apparatus automatically turns itself off eliminating several operations.

DETAILED DESCRIPTION OF THE PREFERRED EMBODIMENT

Figure 1:
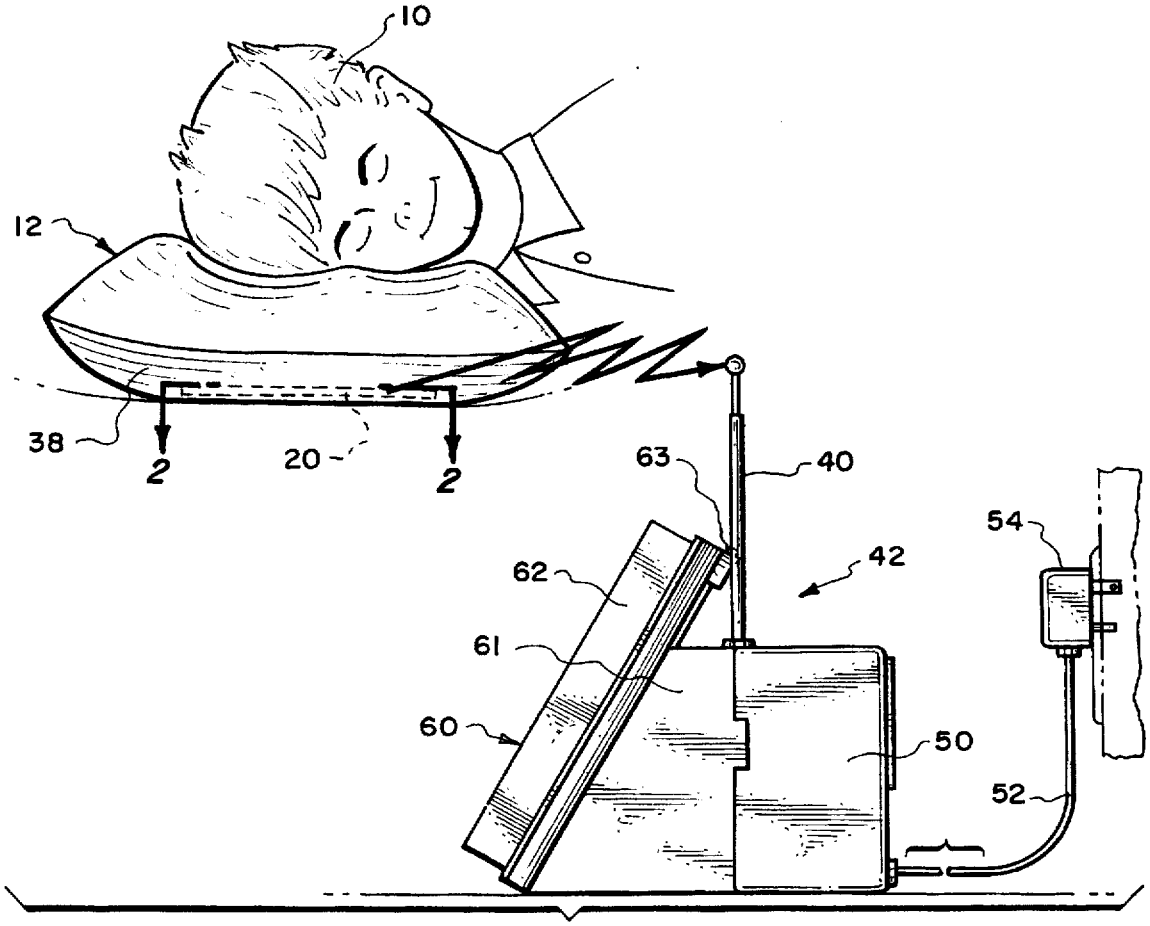
FIG. 1 is a side elevational of the receiver utilized in conjunction with the storybook pillow of the present invention showing the relationship of the separately located receiver to the transmitter which is mounted in conjunction with the pillow which is to be used by a human.
Figure 2:
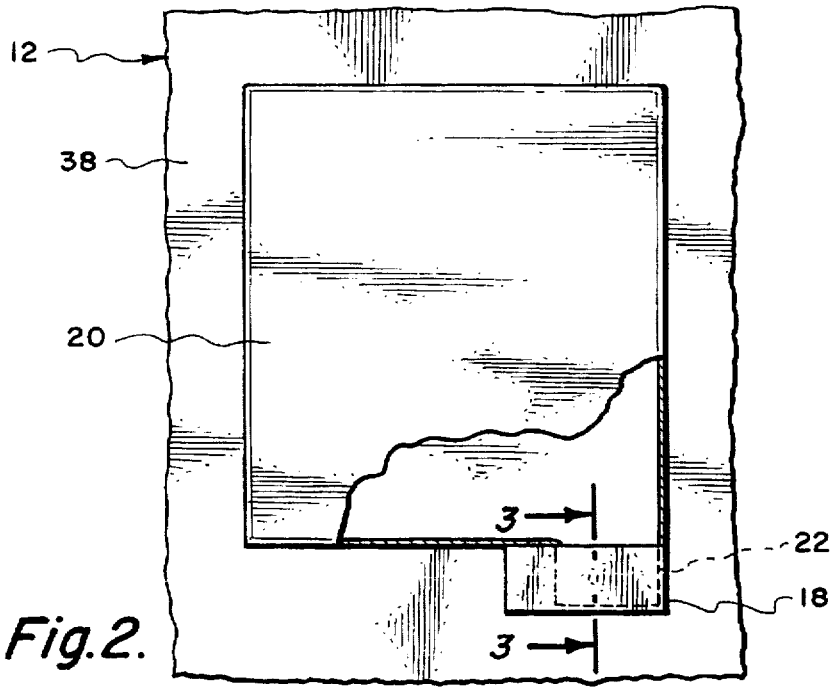
FIG. 2 is a cross-sectional top view through the pillow taken along line 2—2 of FIG. 1 which is shown partially cut away showing the small sized transmitter compartment utilized in conjunction with the main compartment of the pillow.
Figure 5:
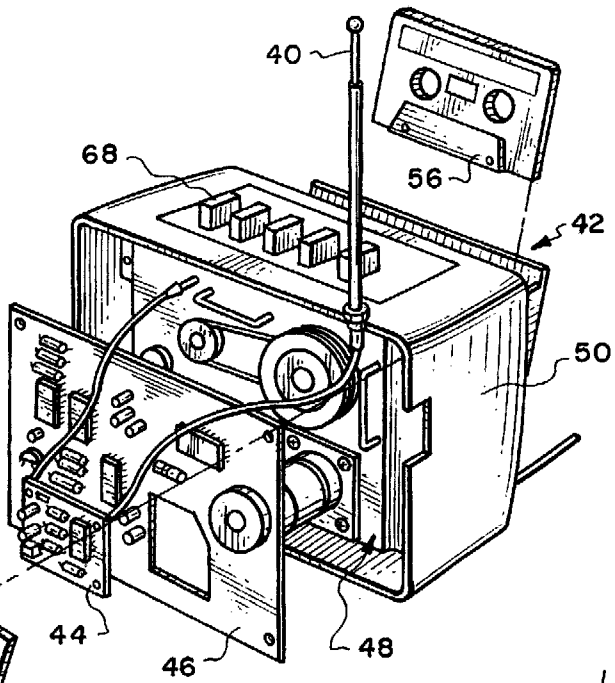
FIG. 5 is an exploded isometric view of the receiver utilized in conjunction with the storybook pillow of the present invention.
Figure 3:
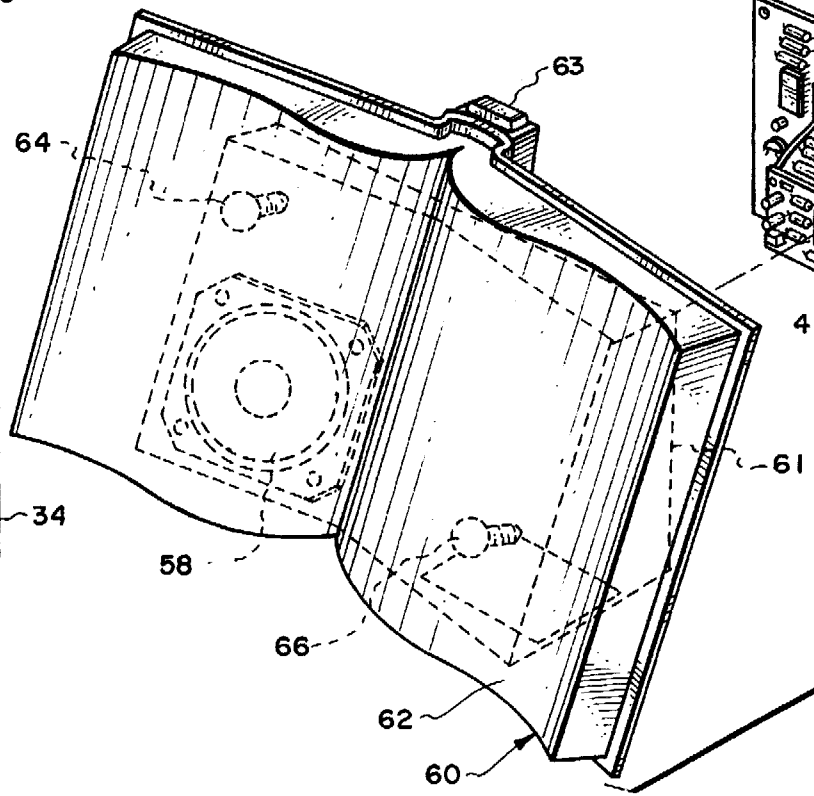
FIG. 3 is a cross-sectional view taken along line 3—3 of FIG. 2 showing the foam padding covering the inflatable bladder arrangement utilized in conjunction with the main compartment of the pillow and the inflatable bladder arrangement utilized in conjunction with the transmitter compartment of the pillow.
Figure 3:
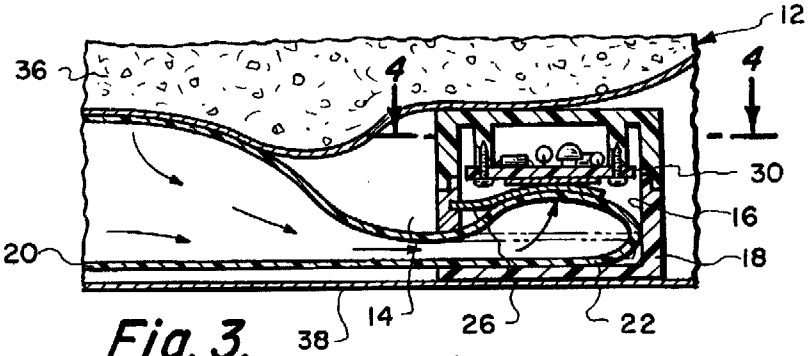
Figure 4:
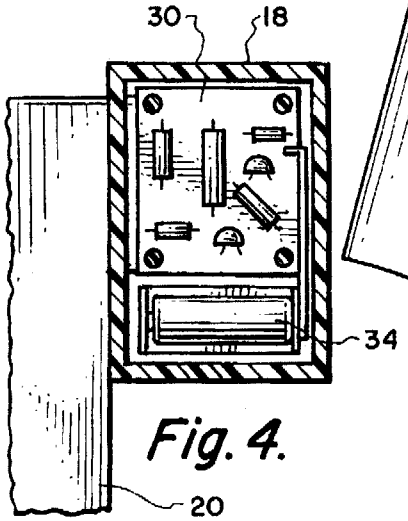
FIG. 4 is a cross-sectional view through the transmitter compartment of the pillow taken along line 4—4 of FIG. 3.

Referring particularly to the drawings there is shown in FIG. 1 the head 10 of a human resting on a pillow 12. The pillow 12 includes a main internal compartment 14 and a transmitter compartment 16. The transmitter compartment 16 is formed by a hard-shelled enclosing housing 18. Located within the main internal compartment 14 is an enlarged bladder 20. Located within the transmitter compartment 16 is a small sized bladder 22. The bladders 20 and 22 are interconnected so that when pressure is applied to the enlarged bladder 20 air is moved within the small bladder 22 causing the small sized bladder 22 to enlarge. This enlargement of the small sized bladder 22 moves electrical contact 26 into physical connection with an electrical contact 28. Electrical contact 28 is mounted on a printed circuit board 30. The printed circuit board 30 is fixedly mounted to the housing 18. The electrical contacts 26 and 28 comprise pillow switch 32. Mounted on the printed circuit board 30 is an electronic circuit which is shown schematically in FIG. 6 of the drawings. This electronic circuit is to be supplied power by a battery 34. The housing 18 and the enlarged bladder 20 are covered by a layer 36 of a soft resilient material such as a foam. The layer 36, enlarged bladder 20 and housing 18 are encased in a pillow cover 38.

Figure 7:
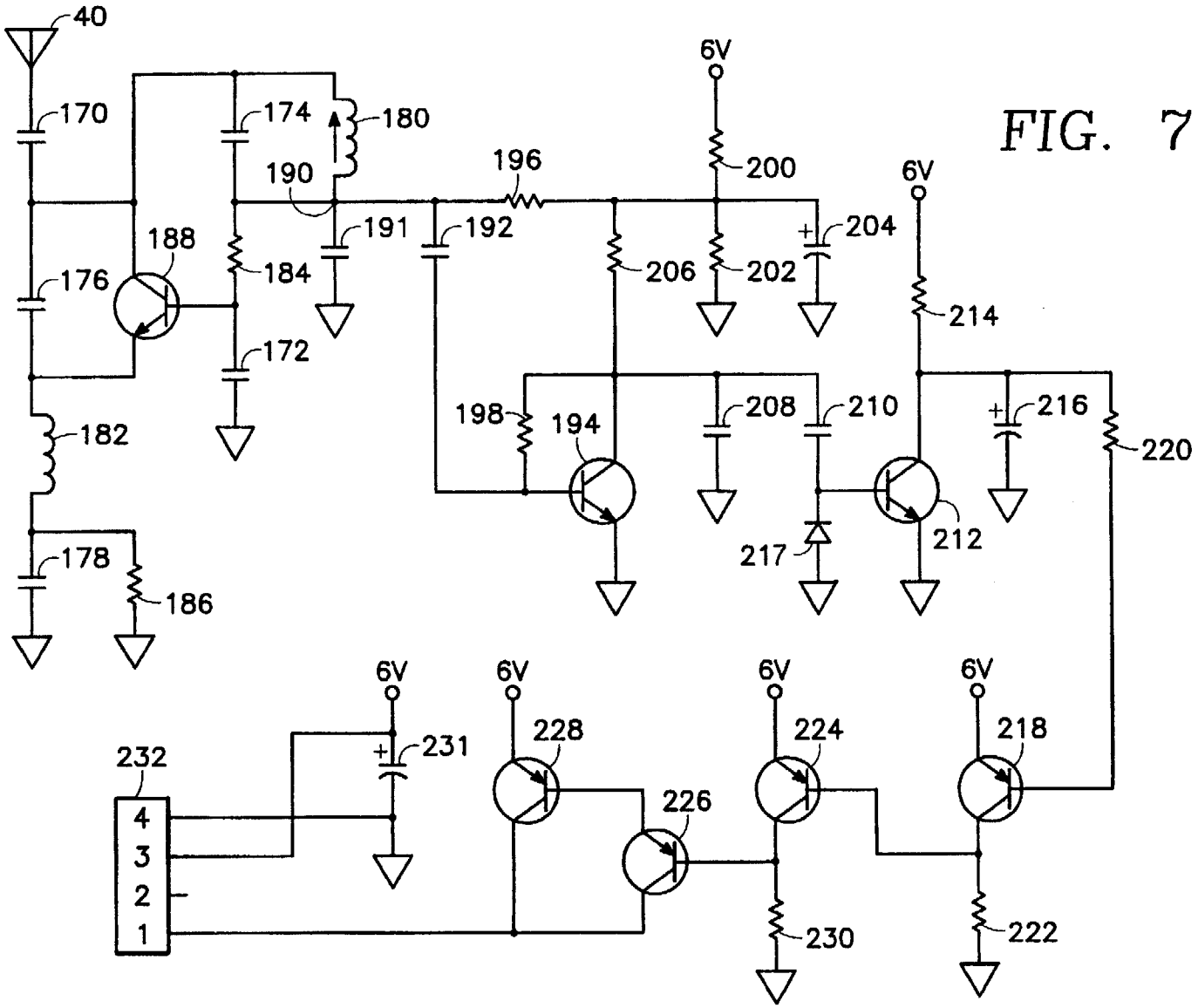
FIG. 7 is an electrical schematic of the receiver circuitry utilized in conjunction with the storybook pillow of the present invention.

When pressure is applied to the pillow 12 and movement of air from enlarged bladder 20 into small sized bladder 22 to enlarge such resulting in contacts 26 and 28 physically contact each other, a signal is produced which is picked up by the antenna 40 of the receiver 42. The signal is supplied to the small printed circuit board 44 which is mounted on a large printed circuit board 46. The printed circuit boards 44 and 46 include the electronic circuitry shown in FIG. 7. The electronic circuitry shown in FIG. 7 is used to operate cassette tape player 48 which is mounted in housing 50. Electrical energy is supplied to the cassette tape player 48 and the printed circuit boards 44 and 46 by means of an electrical conductor 52 which terminates in an electrical outlet plug 54 which is to be plugged within a conventional electrical outlet socket (not shown). A cassette tape 56 is to be mountable in conjunction with the housing 50 and the cassette tape player 48 which reproduces the desired sound by means of speaker 58 that was recorded on the cassette tape 56. Speaker 58 is mounted in conjunction with a configuration of a book 60. The book 60 would normally have translucent leaves 62 that would normally include a writing that are coordinated with the words that are broadcast from the speaker 58. It would normally be desirable to illuminate the words on the leaves 62 because the book 60 will be used in a darkened environment. In order to achieve this illumination, light bulbs 64 and 66 are mounted in conjunction with the book 60 and located behind the leaves 62. The light bulbs 64 and 66 are activated by manually pressing button 63. The book 60 is mounted on a base 61. The base 61 is secured to the housing 50.

In order to activate the storybook pillow of this invention, the button 68 mounted on the housing 50 is to be pressed. Immediately a timer circuit will be activated which will keep the receiver powered for a preset period of time, such as fifteen minutes to an hour. After that period of time the receiver 42 will automatically be deactivated.

When the child's head is located on the pillow 12 and the contacts 26 and 28 are closed, the transmitter located within transmitter compartment 16 is enabled for forty milliseconds, once every half second. This forty millisecond enabling period and half second repetition rate was chosen to minimize battery current draw and also provide a quick (couple seconds) detection interval when the child removes his or her head 10 from the pillow 12. When the child is resting on the pillow 12, the forty millisecond pulse of a radio frequency signal is generated twice a second and coupled into a twenty inch wire antenna 140 which is embedded within the pillow 12 but not shown in FIGS. 1 to 5. This antenna 140 broadcasts the radio frequency pulses to the receiver 42. As long as these pulses are transmitted, the receiver keeps the playback device activated which is depicted as a cassette tape player 48.

When the child removes his or her head from the pillow 12, the air pressure is released within the small sized bladder 22 which causes the contacts 26 and 28 to separate. This removes the power of the battery 34 from the transmitter which terminates the forty milliseconds radio frequency pulses. When the pulses cease, the receiver 42 "times out" and deactivates the cassette tape player 48 a couple of seconds later.

Only when button 68 is pressed will the transmitter begin emitting a signal. When button 68 is pressed, battery 34 supplies voltage through diode 70 resulting in a 8.3 volt output at the cathode of diode 70. This voltage powers the 5 volt Zener diode regulator circuit comprised of the 5.1 volt Zener diode 72 and current limiting resistor 74. Capacitor 76 is connected across Zener diode 72 to provide a clean five volts of output power.

Five volts generated by the Zener diode regulator circuit is applied to stage 78 and chip 80. Chip 80 is a fourteen stage binary counter chip. Its reset line 82 is raised to five volts while switch 68 is depressed by way of a second Zener diode circuit composed of Zener diode 84, resistor 86 and resistor 88. This resets the output of chip 80 to zero. Resistor 88 pulls the reset line low (false) when the button 68 is released.

The resultant low state of the output of chip 80 is inverted by the Schmitt trigger invertor stage 90. The output line 92 of the Schmitt trigger invertor stage 90 is thus high and turns on transistor 94 by way of current limiting resistor 96. Pull down resistor 98 insures that transistor 94 is off when the signal within output line 92 is low.

Transistor 94 then turns on transistor 100 by providing a base emitter current path through resistor 102 to the collector of the saturated transistor 94. When transistor 94 is off, pull down resistor 104 ensures that transistor 100 is also off.

With transistor 100 turned on and saturated, the 9 volt voltage from the battery 34 passes through the emitter collector junction of transistor 100 with only a 0.1 voltage drop. The resulting 8.9 volts at the collector of transistor 100 now powers Zener diode 72 and resistor 74, the 5 volt Zener diode regulator circuit, which in turn powers the chips 78 and 80. Thus the circuit remains powered up and latched after button 68 is released.

Note that the diode 70 no longer conducts at this point since the forward drop across is only 0.1 volts. This diode 70 is still needed, however, to prevent the 8.9 voltage output from feeding back to the reset pin of chip 80 and causing a continuous reset of the counter located within the chip 80.

Chip 78 is configured as a low frequency oscillator to clock the counter within chip 80. Resistor 106 and capacitor 108 set the frequency of the low frequency oscillator to a nominal value of 2.0 Hertz (Hz). This output is also used to gate the transmitter two times a second which will now be described. The 2.0 Hz clock input to the chip 80 results in the counter within the chip 80 being incremented every half second. The output 110 of chip 80 will go high after $2^{13}$ number of counts (8,192 counts). Since each count represents one-half second, then the output of chip 80 in line 110 goes high 8,192×0.5 seconds or one hour and eight minutes after the button 68 has been pressed and released.

When line 110 goes high, this signal is again inverted by the Schmitt trigger inverter stage 90. The output of this Schmitt trigger inverter stage 90 thus goes low which turns off transistor 94. With transistor 94 turning off, transistor 100 is turned off which removes the nine volt battery power from battery 34 from the electronics. Thus the battery life is conserved by powering down the electronics about an hour after the unit is first activated. It is to be understood that the period of time can be varied to any desired length of time.

The radio frequency oscillator and transmitter circuit is comprised of transistors 112 and 114, resistors 116, 118, 120 and 122, capacitors 124 and 126, inductor 128 and crystal 130. Capacitors 132, 134 and 136 along with inductor 138 are used to resonantly couple the radio frequency output signal of transistor 112 to the twenty inch wire antenna 140 which has been previously mentioned. Capacitor 141 provides noise filtering for the nine volt voltage from battery 34.

This radio frequency oscillator and transmitter circuit resonates at the frequency of crystal 130 which is 49.866

Mhz (Megahertz) when the transmitter is enabled. This is a common frequency used in short range, radio controlled toy applications. When the transmitter is enabled, the output signal applied to the antenna 140 is approximately 1.5 volts peak-to-peak. However, the output signal is not a continuous carrier wave. This output signal consists of a duty-cycled pattern having an on period (carrier present) of 1.36 milliseconds and an off period (carrier absent) of 0.14 milliseconds. It is this punctuated off period that will enable radio frequency signal detection in the receiver circuit located within the cassette tape player 48.

The two Hertz output of the low frequency oscillator stage 78 is used to gate the transmitter on twice per second whenever the switch 32 is closed. When low frequency oscillator stage 78 goes high, it turns off diode 142. Diode 144 is also high momentarily since capacitor 146 was previously discharged through resistor 148 when the output of low frequency oscillator stage 78 was low. Thus with capacitor 146 discharged, a low state is presented to the input line 150 of the stage 152 of the chip of which low frequency oscillator stage 78 and Schmitt Trigger Inverter Stage 90 are also part. Thus with capacitor 146 discharged, a low state is presented to input line 150 which is then inverted to a high level output at the cathode of diode 144.

Diodes 142 and 144 basically create a logic AND gate. With the cathodes of diodes 142 and 144 both high, the wired anodes go high by way of pull up resistor 154. This presents a logic high to the input line 156 of stage 158. Stage 158 is wired in series with the second invertor stage 160 in order to provide sufficient drive power for turning on transistor 162. Stages 158 and 160 are part of the same integrated circuit of stages 78, 90 and 152. This integrated circuit comprises a HEX Schmitt Trigger Inverter Chip. Thus with the AND output high (line 156 high), transistor 162 is turned on by way of resistor 164 and the high output state presented by stage 160. Resistor 166 provides a pull down function to insure that transistor 162 is off when the output of stage 160 is low. With transistor 162 on and saturated, the RF (radio frequency) transmitter circuit now has a return path to ground and is therefore powered up. The circuit thus begins to broadcast the 49.86 Mhz signal to the cassette tape player 48. In the meantime, the capacitor 146 is charging up to resistor 148 as a result of the high output level of stage 78. When the voltage reaches the logic "1" transition threshold of stage 152, the output of stage 152 goes low. This occurs in about 40 milliseconds. Stage 152 going low pulls the cathode of the diode 144 to ground. This in turn presents a low logic level to the input line 156 of stage 158. Thus, the output line 168 of stage 160 also goes low which turns off transistor 162. When transistor 162 is off, the transmitter ground connection opens which powers down the transmitter. It is to be understood that stages 152, 158 and 160 are also part of the chip which includes stages 78 and 90.

The net result is the transmitter is enabled for only 40 milliseconds every half second. The purpose of pulsing the transmitter in this manner is to minimize power draw from the battery 34. If the transmitter was continually powered when switch 32 is closed, the transmitter circuit would pull a constant current of 42 milliamps (ma). This pulsing feature reduces the average current draw of the transmitter to only 3.4 ma which significantly extends battery life.

Figure 6:
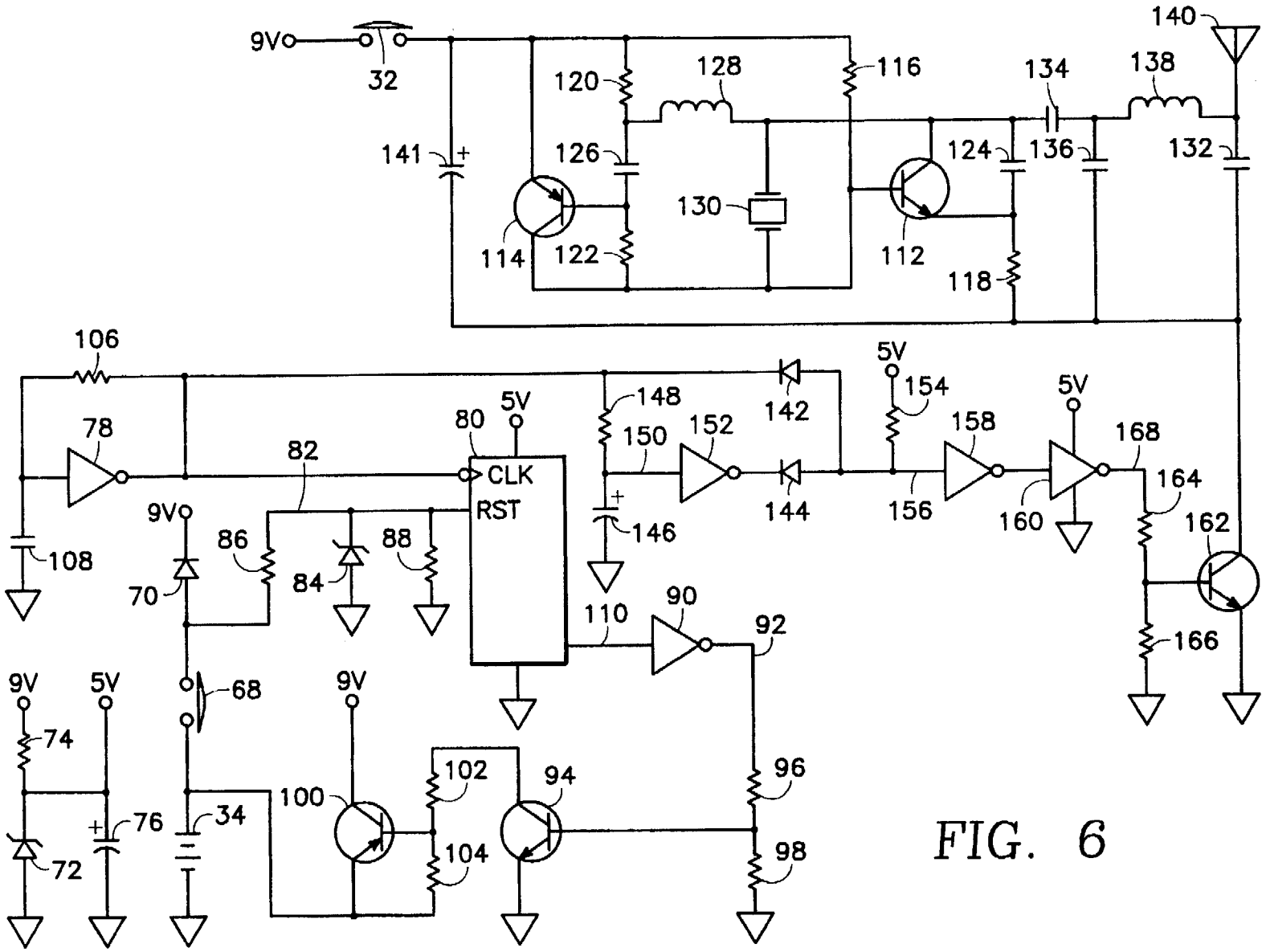
FIG. 6 is an electrical schematic of the circuitry utilized with the transmitter within the storybook pillow of the present invention.

The chip composed of stages 78, 90, 152, 158 and 160 is available by several different manufacturers. However, a typical chip would be part number 74HC14 manufactured by National Semiconductor. Chip number 80 is also available from several different manufacturers with part number HC4020 of National Semiconductor being typical. Typical values within the transmitter circuit shown in FIG. 6 is as follows: Resistor 106, 62 kΩ (kilo-ohms); capacitor 108, 10 uf (microfarads); resistor 148, 110 kΩ; capacitor 146, 0.47 uf; resistor 154, 10 kΩ; resistor 164, 4.3 kΩ; resistor 166, 10 kΩ; resistor 86, 330 Ω (ohms); resistor 88, 100 kΩ; resistor 122, 220 kΩ; inductor 128, 1 uH (microHenry); resistor 96, 100 kΩ; resistor 98, 100 kΩ; resistor 102, 3.9 kΩ; resistor 104, 100 kΩ; capacitor 76, 4.7 uf; resistor 74, 330 Ω; capacitor 141, 100 uf; resistor 120, 2 106 ; capacitor 126, 0.022 uf; crystal 130, 49.9 Mhz; resistor 116, 33 k; capacitor 124, 22 pf (picofarads); capacitor 134, 10 pf; inductor 138, 1 uH; capacitor 136, 47 pf; resistor 118, 22 Ω; and capacitor 132, 10 pf.

The receiver circuit is basically a transistor based tank circuit with a variable inductor that is tuned to provide resonance at 49.86 Mhz which is the broadcast transmit frequency. The pulses received from the transmitter circuit by the receiver circuit are transformed into a low voltage DC (direct current) signal that turns on a transistor switch which provides power to the cassette tape player 48. As long as the 49.86 Mhz pulse is received every half second, the receiver keeps the cassette tape player 48 powered. If the transmitter stops sending these pulses, which occurs when the child takes head 10 off the pillow 12, then the transformed DC level rises. This causes the cassette tape player 48 to be turned off. When the radio frequency pulses are resumed from the transmitter, in other words what occurs when the head 10 is placed back on the pillow 12, the DC signal goes low which turns on the tape cassette player 48.

The 49.86 Mhz pulses from the transmitter mounted within the pillow 12 are received by way of a telescoping antenna 40. With this telescoping antenna 40 extended (to seventeen inches), the transmitter and receiver can be separated by at least twenty feet and still operate reliably. The signal from the antenna 40 is coupled into an active resonant circuit comprised of capacitors 170, 172, 174, 176 and 178. This active resonant circuit also comprises inductors 180 and 182. This active resonant circuit also includes resistors 184 and 186 and transistor 188.

In the absence of a radio frequency signal input, the output of this active resident LC circuit at connecting point 190 is a small amplitude 200 Khz (kilohertz) sawtooth like waveform that rides a 2.5 volt DC level. When radio frequency is broadcast from the pillow 12, positive pulses appear on this waveform which are approximately 0.5 volts in amplitude, 0.3 milliseconds wide and spaced every 1.2 milliseconds. These pulses correspond to the 0.14 milliseconds interval where the pillow transmitter is turned off during its 1.36 milliseconds on, 0.14 milliseconds off transmission pattern.

This detected stream of radio frequency pulses is AC (alternating current) coupled by way of capacitor 192 into an amplifier stage composed of transistor 194 and DC biasing component resistors 196, 198, 200 and 202. Capacitor 204 is used to filter out any radio frequency noise and provide a clean supply signal to the transistor 194. Resistor 206 is used to both bias the transistor 194 and set the gain of the amplifier. Capacitor 208 is used in combination with resistor 206 to provide a low pass filter function to suppress the 200 KHz sawtooth waveform at the amplifier output. The output of the amplifier is at the collector of transistor 194 comprises a negative pulse stream with an amplitude of approximately 1.2 volts.

The DC negative pulse stream is AC coupled by way of capacitor 210 into a second transistor stage comprised of transistor 212, resistor 214, capacitor 216 and diode 217. The capacitor 210, diode 217 and base-emitter of transistor 212 convert the pulse stream into an AC signal. Diode 217 provides a return path to ground during the negative cycle of the pulse input. The base-emitter junction of the transistor 212 conducts during the positive cycle of the pulse input. This turns on transistor 212 during the positive pulse cycle which discharges capacitor 216.

As long as the transmitter within the pillow 12 is active, in other words the head 10 resting on the pillow 12, the continuously received pulse stream allows transistor 212 to keep the voltage across capacitor 216 clamped to a 0.1 voltage which is the saturation voltage of the collector emitter junction transistor 212. Thus, the pulse stream detected by the receiver 42 has been transformed into a low level DC voltage. This low level DC voltage is routed to a transistor switch circuit comprised of transistor 218 and resistors 220 and 222. This low level input voltage turns on transistor 218 causing 5.9 volts to appear across resistor 222. This voltage is presented to the base of transistor 224. This turns off transistor 224 since its emitter is at 6 volts. Since only 0.1 volts appear across the base-emitter of transistor 224, transistor 224 is turned off. With transistor 224 turned off, it is effectively removed from the circuit of the last stage which is composed of transistors 226 and 228. The transistors 226 and 228 are arranged in a Darlington configuration.

Transistors 226 and 228 are both turned on by way of resistor 230 which provides a ground path for the base-emitter currents for each of the transistors 226 and 228. With each of the transistors 226 and 228 conducting, the voltage present at the collector of transistor 228 is 0.8 volts lower than the emitter voltage of transistor 228. If the supply voltage from conductor 52 (see FIG. 1) is at 6.8 volts, then 6 volts would be present at the collector of transistor 228. This voltage is then used to power the cassette player 48 by way of connector 232. The connector 232 is to be plugged in to the cassette player 48.

When the detected radio frequency pulse stream terminates which occurs when the child lifts head 10 from the pillow 12, transistor 212 no longer is conductive. This allows capacitor 216 to charge to 6 volts through resistor 214. It takes a couple of seconds for the capacitor 216 to charge up to 6 volts which then turns off transistor 218 since the base and emitter junctions of transistor 218 are now at the same 6 volt potential. With the transistor 218 turned off, transistor 224 is now able to turn on by way of resistor 222 which provides a ground path for transistor's 224 emitter based current. The voltage across resistor 230 is now raised to 5.9 volts with transistor 224 being fully saturated. This causes the Darlington transistor pair 226 and 228 to turn off due to the 0.1 volt potential between the emitter of transistor 228 and the base of transistor 226. Thus, power is removed from the cassette tape player 48. The net effect is that there is a couple of seconds of time delay set by the components of resistor 214 and capacitor 216 between the time that the child takes his or her head 10 off the pillow 12 and when the cassette tape player 48 halts. This is an intentional delay which makes the system immune to noise and brief movements in the child's head position on the pillow 12.

Typical values for the components in the receiver circuit shown in FIG. 8 are as follows: Capacitor 170, 10 pf; capacitor 176, 33 pf; inductor 182, 33 uH; capacitor 178, 2200 pf; capacitor 174, 10 pf; resistor 184, 300 kΩ; capacitor 172, 0.033 uf; inductor 180, 0.358 uH; capacitor 192, 0.047 uf; resistor 196, 2.2 kΩ; resistor 198, 470 kΩ; resistor 206, 10 kΩ; resistor 200, 330 Ω; resistor 202, 330 Ω; capacitor 208, 0.01 uf; capacitor 204, 100 uf; capacitor 210, 047 uf; resistor 214, 15 kΩ; capacitor 216, 100 uf; resistor 220, 100 kΩ; resistor 222, 10 kΩ; resistor 186,680 ohms; capacitor 231, 10 uf; and resistor 230, 10 kΩ.

What is claimed is:

1. A storybook pillow comprising:

a pillow;

a radio transmitter mounted within said pillow, upon sufficient physical pressure being applied to said pillow said transmitter emitting a signal;

a radio receiver spaced from said pillow but located in close proximity thereto, a sound playback device mounted in conjunction with said radio receiver, upon said radio receiver receiving said signal said sound playback device being activated reproducing a recorded sound, said pillow including a main internal chamber and separate transmitter chamber, said transmitter chamber being substantially smaller than said main chamber, said transmitter being mounted within said transmitter chamber; and a pressure actuated switch mounted within said transmitter chamber, said pressure actuator switch being closed upon sufficient physical pressure being applied to said pillow which causes said transmitter to emit said signal.

2. A storybook pillow as defined in claim 1 wherein:

said transmitter chamber including an inflatable diaphragm, upon said inflatable diaphragm being inflated and expanded said pressure actuated switch being moved from an open position to a closed position upon said sufficient physical pressure being applied to said pillow.

3. A storybook pillow as defined in claim 2 wherein:

said radio receiver being mounted in conjunction with a representation of a book, said book being located in an open configuration, said book including a printed story, said recorded sound comprising said story.

4. A storybook pillow as defined in claim 3 wherein:

said radio receiver being mounted in conjunction with a representation of a book, said book being located in an open configuration, said book included a printed story, said recorded sound comprising said story.

5. A storybook pillow as defined in claim 3 wherein:

said pillow having a main chamber and a transmitter chamber, said transmitter chamber being substantially smaller in size than said main chamber, an enlarged inflatable bladder being mounted within said main chamber, a small sized inflatable bladder being mounted within said transmitter chamber, said enlarged inflatable bladder connecting with said small sized inflatable bladder, whereby a pressure being applied to said enlarged inflatable bladder will result in decreasing physical size of said enlarged inflatable bladder and increasing the physical size of said small sized inflatable bladder which causes activation of said radio transmitter mounted within said transmitter chamber.

6. A storybook pillow comprising:

a pillow;

a radio transmitter mounted within said pillow, upon sufficient physical pressure being applied to said pillow said transmitter broadcasting a signal;

radio receiver spaced from said pillow but located in close proximity thereto, a sound playback device mounted in conjunction with said radio receiver, upon said radio receiver receiving said signal said sound playback device being activated reproducing a recorded sound; and said radio receiver being mounted in conjunction with a representation of a book, said book being located in an open configuration, said book included a printed story, said recorded sound comprising said story.

7. A storybook pillow comprising:

a pillow;

a radio transmitter mounted within said pillow, upon sufficient physical pressure being applied to said pillow said transmitter broadcasting a signal;

a radio receiver spaced from said pillow but located in close proximity thereto, a sound playback device mounted in conjunction with said radio receiver, upon said radio receiver receiving said signal said sound playback device being activated reproducing a recorded sound; and said pillow having a main chamber and a transmitter chamber, said transmitter chamber being substantially smaller in size than said main chamber, an enlarged inflatable bladder being mounted within said main chamber, a small sized inflatable bladder being mounted within said transmitter chamber, said enlarged inflatable bladder connecting with said small sized inflatable bladder, whereby a pressure being applied to said enlarged inflatable bladder will result in decreasing physical size of said enlarged inflatable bladder and increasing the physical size of said small sized inflatable bladder which causes activation of said radio transmitter mounted within said transmitter chamber.

* * * * *